US009649678B2

(12) United States Patent
Frangenberg

(10) Patent No.: US 9,649,678 B2
(45) Date of Patent: May 16, 2017

(54) CLOSING ELEMENT FOR A ROLLING PRESS FRAME

(75) Inventor: Meinhard Frangenberg, Kuerten (DE)

(73) Assignee: KHD HUMBOLDT WEDAG GmbH, Cologne (DE)

( * ) Notice: Subject to any disclaimer, the term of this patent is extended or adjusted under 35 U.S.C. 154(b) by 654 days.

(21) Appl. No.: 13/876,815

(22) PCT Filed: Oct. 11, 2011

(86) PCT No.: PCT/EP2011/067712
§ 371 (c)(1),
(2), (4) Date: Mar. 28, 2013

(87) PCT Pub. No.: WO2012/049166
PCT Pub. Date: Apr. 19, 2012

(65) Prior Publication Data

US 2013/0186160 A1 Jul. 25, 2013

(30) Foreign Application Priority Data

Oct. 12, 2010 (DE) ..... 10 2010 048 214

(51) Int. Cl.

| | |
|---|---|
| ***B21B 31/16*** | (2006.01) |
| ***B30B 3/04*** | (2006.01) |
| ***B02C 4/02*** | (2006.01) |
| ***B30B 15/04*** | (2006.01) |
| ***B02C 4/28*** | (2006.01) |

(52) U.S. Cl.
CPC ..... *B21B 31/16* (2013.01); *B02C 4/02* (2013.01); *B02C 4/28* (2013.01); *B30B 3/04* (2013.01); *B30B 15/04* (2013.01)

(58) Field of Classification Search
CPC B21B 31/16; B21B 31/26; B30B 3/04; B30B 15/04; B30B 15/044; B30B 15/047; B02C 4/02; B02C 4/28
See application file for complete search history.

(56) References Cited

U.S. PATENT DOCUMENTS 2,994,261 A 8/1961 Cook
3,899,965 A 8/1975 Koch et al.
(Continued)

FOREIGN PATENT DOCUMENTS

DE 102005045273 3/2007
DE 102010015374 A1 10/2011
EP 1147815 10/2001
(Continued)

OTHER PUBLICATIONS

Written Opinion of the International Search Authority for PCT Application No. PCT/EP2011/067712 dated Apr. 12, 2013.
(Continued)

*Primary Examiner* — Teresa M Ekiert
(74) *Attorney, Agent, or Firm* — Greer Burns & Crain, Ltd.

(57) ABSTRACT

A closing element for a machine frame of a rolling press, that sits on the end of a frame element as a hasp. The closing element includes an element enabling a pendular motion on the frame element. In this way, floating mounting of the closing element is achieved. This enables a very fast dismounting that facilitates the replacement of the rolls, and leads to an optimum arrangement of the closing elements on corresponding end pieces of the machine frame.

8 Claims, 1 Drawing Sheet

(56) References Cited

U.S. PATENT DOCUMENTS

| | | | |
|---|---|---|---|
| 7,841,552 | B2 | 11/2010 | Frangenberg et al. |
| 2013/0025476 | A1 | 1/2013 | Frangenberg |

FOREIGN PATENT DOCUMENTS

| | | | |
|---|---|---|---|
| EP | 1374999 | A2 * | 1/2004 |
| FR | 898748 | | 5/1945 |
| FR | 2216105 | | 8/1974 |

OTHER PUBLICATIONS

International Search Report for PCT Application No. PCT/EP2011/067712 mailed May 18, 2012.

* cited by examiner

CLOSING ELEMENT FOR A ROLLING PRESS FRAME

CROSS-REFERENCES TO RELATED APPLICATIONS

This application claims the benefit of the German patent application No. 10 2010 048 214.5 filed on Oct. 12, 2010, the entire disclosures of which are incorporated herein by way of reference.

BACKGROUND OF THE INVENTION

The invention relates to a closing element for a machine frame of a rolling press, which closing element is seated as a lock bush on the end side of a frame element.

For high pressure comminution of bulk material, it is known to allow the bulk material to pass through the roll nip of two rolls which rotate in opposite directions, where the bulk material cracks as a result of the application of high pressure and is pressed to form slugs. In this type of comminution, the material to be comminuted is not comminuted by way of a cutting movement, but rather in the ideal case exclusively by way of the application of high pressure to the bulk material in the roll nip, where the bulk material cracks exclusively as a result of the pressure application.

The forces which occur in the machine frame which holds the two rolls running in opposite directions together are very high here. Accordingly, the aim is to configure the machine frame to be correspondingly stable. As a result of the stable machine frame, the high pressure rolling press quickly gains a great amount of weight. The handling of the individual parts of the frame of the high pressure rolling press and the transport of the rolling press are made more difficult as a result. High costs are produced for the transport of the machine parts to the area of use of the rolling press, the areas of use frequently being mining regions which are relatively undeveloped and lie far away from any infrastructure.

In order to bring about a weight reduction of the entire construction, a change has already been made to statically determine the individual parts individually, in order, as a result, to save weight at the locations where it is possible. There is a further disadvantage of heavy individual parts of the high pressure rolling press if the high pressure rolling press is set up at locations where relatively little infrastructure is available for maintaining and repairing the high pressure rolling presses. In zones of use, in which the service life of the rolling press has a considerable influence on the economic viability of the mine or the material to be produced, a change has therefore been made to rolling press constructions which make it possible to service or replace the rolls with little outlay.

For the above-mentioned reasons, it is desirable to continuously improve the frame construction of rolling presses and to reduce the weight and complexity in the process. One essential criterion for the economic viability of the frame construction is the time period, in which the frame can be dismantled, in order that replacement of the rolls can be carried out simply and inexpensively after their wear according to schedule.

Patent application DE102010015374.5 teaches a machine frame of tuning fork form which receives a system of forces comprising rolling presses and pressing hydraulics which is closed in itself. Said machine frame is closed on each side of the machine frame by way of a frame part piece which is held open as closure which is thrown over the limbs of the tuning fork-shaped machine frame, said frame part piece being seated as a closure in a bay of the limbs of the tuning fork-shaped machine frame and being supported against the hammer head-shaped widened portions which form a bay in the limbs of the tuning fork-shaped machine frame. Said frame part piece as closure is itself of U-shaped construction and lies on the upper limb of a machine frame side of the tuning fork-shaped machine frame and can receive high, horizontally directed forces of the rolls, the forces of the rolls being transmitted via shaft stubs, which are seated in a bearing block, via the bearing block to the frame part piece as closure.

It is important in this construction that the high lateral forces which can occur in the machine frame are transmitted uniformly to the limbs of the tuning fork-shaped machine frame. Without a special precaution, it can occur that the frame part piece as closure becomes wedged in the bay of the limb of the tuning fork-shaped machine frame and can therefore be released from the tuning fork-shaped machine frame only under aggravated conditions during the next dismantling operation.

SUMMARY OF THE INVENTION

It is therefore an object of the invention to provide a closure for a tuning fork-shaped machine frame for a rolling press, which closure does not become wedged.

The object according to the invention is achieved by virtue of the fact that the closing element has means, by way of which a swinging movement on the frame element is made possible.

Further advantageous refinements of the invention are specified in the subclaims.

According to the invention, it is proposed to allow the closing element to carry out a swinging movement even during use. The closing element is therefore not connected fixedly to the frame, but rather it is provided to mount the closing element in a floating manner. In the context of this description, "floating mounting" is understood to mean that the closing element has more than one degree of freedom of movement in use. It can therefore move in the machine frame in more than one degree of freedom. This ensures that, under loading, the closing element is oriented in such a way that it does not become wedged, but rather bears tightly with all bearing faces against corresponding abutments and thus can absorb the maximum, design-related force, without the closing element becoming wedged as a result of undesirable positioning on the machine frame and therefore becoming fastened there in an undesirable manner.

BRIEF DESCRIPTION OF THE DRAWINGS

The invention will be explained in greater detail using the following figures, in which.

DETAILED DESCRIPTION OF THE PREFERRED EMBODIMENTS

Figure 1:
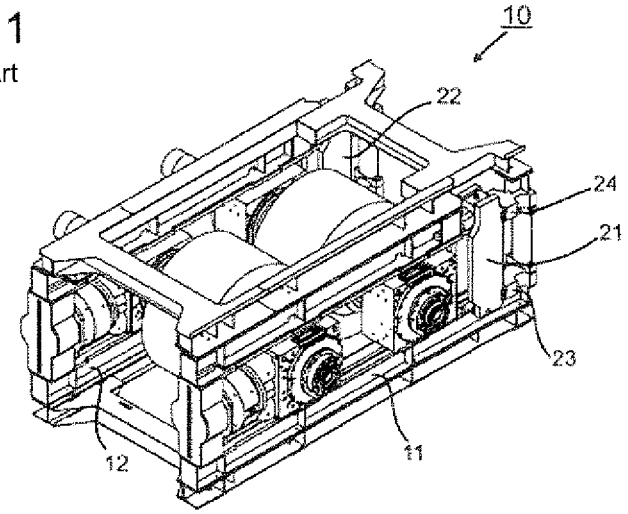
Fig. 1 Prior Art
FIG. 1 shows a machine frame according to patent application DE102010015374.5.
Figure 2:
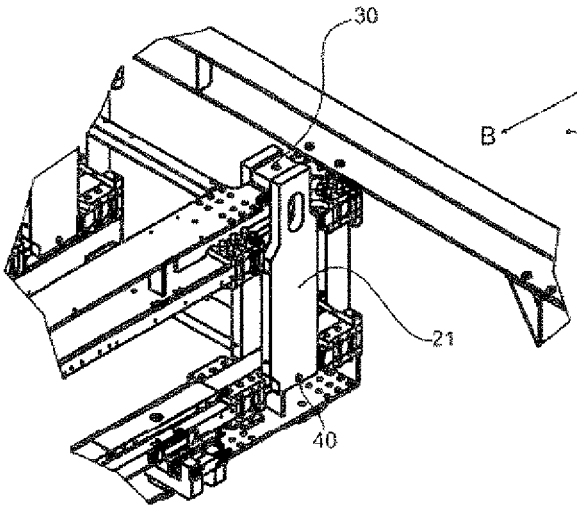
FIG. 2 shows a detail, highlighted from FIG. 1, of the closing element according to the invention.

FIG. 1 shows a machine frame 10 which is described in detail in patent application DE102010015374.5 and has, as essential element, two tuning fork-shaped frame constituent parts 11 and 12 which are open to the rear in this illustration.

Approximately rectangular frames which give the entire machine frame 10 the necessary torsional stability lie on the tuning fork-shaped frame constituent parts 11 and 12. In order to close the two tuning fork-shaped frame constituent parts 11 and 12 to the rear, it is provided that two closing elements 21 and 22 are placed from above onto the tuning fork-shaped frame constituent parts 11 and 12. Said closing elements have a U-shape and engage with their limbs in each case around a limb of the tuning fork-shaped frame constituent part. Here, the closing elements 21 and 22 engage into bays of the tuning fork-shaped frame constituent parts 11 and 12 and, in the case of horizontal loading, are supported against hammer head-shaped end pieces 23 and 24 of the tuning fork-shaped frame constituent parts 11 by way of antifriction bearings which are situated inside the tuning fork-shaped frame constituent parts 11. According to the invention, it is provided that said closing elements 21 and 22 are not connected fixedly to the tuning fork-shaped frame constituent parts 11, but rather are mounted on the latter in a floating manner.

Figure 3:
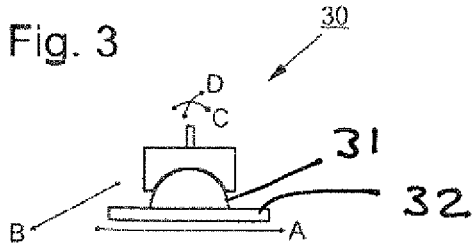
FIG. 3 shows a sliding ball-head bearing for supporting the closing element according to the invention.

The floating action is achieved in each case by an element comprising a displaceable bearing 30, which displaceable bearings 30 are arranged on the inner side of the connecting piece of the two limbs of the U-shaped closing elements 21 and 22 and have a ball-head joint 31 there which is depicted in FIG. 3 and has a sliding plate 32 which is likewise depicted in FIG. 3. As a result of the sliding plate 32, the closing elements 21 and 22 are mounted freely in two translatory degrees A and B, the ball-head joint 31 giving the closing elements two rotational degrees of freedom C and D. Apart from a vertical movement, the closing elements 21 and 22 can assume virtually any desired position at the moment, at which they lean against the hammer head-shaped ends 23 and 24 of the tuning fork-shaped frame constituent parts 11, and fall into the positions which are defined by the contact points of the hammer head-shaped end pieces 23 and 24 of the tuning fork-shaped frame constituent parts 11. The closing elements 21 and 22 which are mounted in a floating manner firstly permit rapid opening of the tuning fork-shaped frame constituent parts 11 and 12 in order to replace the rolls which are contained therein and have to be exchanged or reconditioned after a predefined time on account of wear, and secondly the closing elements 21 and 22 which can be opened rapidly make an always optimum contact possible with the hammer head-shaped end pieces 23 and 24 of the tuning fork-shaped frame constituent parts 11 and 12, which hammer head-shaped end pieces 23 and 24 serve as abutments.

In order that the closing elements 21 and 22 are not released unintentionally from the machine frame 10, it is provided that said closing elements 21 and 22 are preferably secured by a securing bolt 40. The securing bolts 40 can in each case have a cotter pin, by way of which the securing bolts 40 are secured in the closing elements 21 and 22, or else can in each case have a thread, by way of which the securing bolts 40 are secured in the closing elements 21 and 22. In order to prevent the respectively two limbs of the closing elements 21 and 22 being pulled against one another too tightly during the tightening of the screw connection of the securing bolts 40, as a result of which the closing elements 21 and 22 might become wedged in an undesirable manner, it is provided that the securing bolts 40 have a greater diameter than the respective threaded head (not shown here). This protects the closing element 21 and 22 from being pulled against one another by excessively tight tightening on the corresponding, tuning fork-shaped frame elements 11 and 12, and thus from being capable of becoming wedged.

As an alternative to the ball-head joint 31, it is also possible that the closing elements 21 and 22 are mounted with the aid of an element such as a needle bearing with two rotational degrees of freedom.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF DESIGNATIONS

10 Machine frame
11 Frame constituent part
12 Frame constituent part
21 Closing element
22 Closing element
23 End piece
24 End piece
30 Bearing
31 Ball-head joint
32 Sliding plate
40 Securing bolt
A Translatory degree of freedom
B Translatory degree of freedom
C Rotational degree of freedom
D Rotational degree of freedom

The invention claimed is:

1. An assembly including, in combination, a machine frame of a rolling press and a closing mechanism for the machine frame, the assembly comprising:

wherein the machine frame comprises a frame element that includes a first frame limb and a second frame limb, and wherein the closing mechanism comprises:

a closing element, wherein the closing element comprises a U-shaped form defined by two limbs connected to each other by a connecting element, wherein the closing element straddles end portions of both the first and second frame limbs of the frame element, such that said closing element defines a lock bush on the frame element, wherein the closing element is mounted on the frame element by means of a mounting element such that the closing element can execute a swinging movement with respect to the frame element, wherein the mounting element is arranged on an inner side of the connecting element of the closing element, wherein the mounting element comprises a ball-head joint, and wherein the mounting element is guided displaceably on the frame element by a sliding plate.

2. The assembly as claimed in claim 1, wherein the mounting element which makes the swinging movement possible is configured displaceably on the frame element.

3. The assembly as claimed in claim 1, wherein the two limbs of the closing element are secured against unintended release by a securing bolt with a cotter pin.

4. The assembly as claimed in claim 1, wherein the two limbs of the closing element are secured against unintended release by a securing bolt with a thread, and further wherein the thread diameter is smaller than the diameter of the remaining securing bolt.

5. An assembly including, in combination, a machine frame of a rolling press and a closing mechanism for the machine frame, the assembly comprising:

wherein the machine frame comprises a frame element that includes a first frame limb and a second frame limb, wherein the closing mechanism comprises:

a closing element, wherein the closing element comprises a U-shaped form defined by two limbs connected to each other by a connecting element, wherein the closing element straddles end portions of both the first and second frame limbs of the frame element, such that the closing element defines a lock bush on the frame element, wherein the closing element is mounted on the frame element by means of a mounting element such that the closing element can execute a swinging movement with respect to the frame element, wherein the mounting element is arranged on an inner side of the connecting element of the closing element, wherein the mounting element comprises a needle bearing, and wherein the mounting element is guided displaceably on the frame element by a sliding plate.

6. The assembly as claimed in claim 5, wherein the mounting element which makes the swinging movement possible is configured displaceably on the frame element.

7. The assembly as claimed in claim 5, wherein the two limbs of the closing element are secured against unintended release by a securing bolt with a cotter pin.

8. The closing mechanism as claimed in claim 5, wherein the two limbs of the closing element are secured against unintended release by a securing bolt with a thread, and further wherein the thread diameter is smaller than the diameter of the remaining securing bolt.

* * * * *